US007239089B2

(12) United States Patent
Suzuki et al.

(10) Patent No.: US 7,239,089 B2
(45) Date of Patent: Jul. 3, 2007

(54) POWER SUPPLY APPARATUS FOR HIGH PRESSURE DISCHARGE LAMP

(75) Inventors: Yoshikazu Suzuki, Hyogo (JP); Tomoyoshi Arimoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/196,259

(22) Filed: Aug. 4, 2005

(65) Prior Publication Data

US 2006/0028151 A1 Feb. 9, 2006

(30) Foreign Application Priority Data

Aug. 4, 2004 (JP) ..... 2004-227742
Dec. 7, 2004 (JP) ..... 2004-353580

(51) Int. Cl.
*H05B 37/02* (2006.01)

(52) U.S. Cl. ..... 315/209 R; 315/291; 315/362

(58) Field of Classification Search ..... 315/209 R, 315/224, 225, 226, 209 T, 209 CD, 291, 315/307, 362, DIG. 7
See application file for complete search history.

(56) References Cited

U.S. PATENT DOCUMENTS 6,005,356 A * 12/1999 Horiuchi et al. ..... 315/307
6,225,754 B1 * 5/2001 Horiuchi et al. ..... 315/246

FOREIGN PATENT DOCUMENTS

JP 318873 B2 5/2001
JP 2002-343588 * 11/2002

* cited by examiner

*Primary Examiner*—Thuy Vinh Tran
(74) *Attorney, Agent, or Firm*—Radar, Fishman & Grauer PLLC

(57) ABSTRACT

It is an object of the present invention to provide a high pressure discharge lamp capable of shifting to arc discharge without going out at initial lighting. The object of the invention is achieved by a high discharge lamp in which mercury of 0.15 mg/mm$^3$ is enclosed, and a power supply apparatus. The power supply apparatus comprises a chopper circuit including a switching element, and a smoothing circuit including at least one smoothing capacitor connected to an output terminal of the chopper circuit, and a feedback system control circuit which drives the switching element of the chopper circuit, wherein a parallel circuit comprising a resistor and a second switching circuit is in series connected to an output terminal of the smoothing circuit, and at least at time of initial lighting, the second switching circuit is turned off, and when the lamp is stabilized, the second switching element is turned on.

5 Claims, 7 Drawing Sheets

| | | Time from Extinction to Restart | | | |
|---|---|---|---|---|---|
| Resistance | Voltage | 1'00" | 1'30" | 2':00" | 2'30" |
| Non | — | O | O | × | × |
| 40Ω | 40V | O | O | × | × |
| 50Ω | 50V | O | O | × | O |
| 60Ω | 60V | O | O | O | O |
| 70Ω | 70V | O | O | O | O |
| 100Ω | 100V | O | O | O | O |
| 200Ω | 200V | O | O | O | O |
| 300Ω | 300V | O | O | O | O |

FIG. 6

POWER SUPPLY APPARATUS FOR HIGH PRESSURE DISCHARGE LAMP

FIELD OF THE INVENTION

The present invention relates to a high-pressure discharge lamp lighting apparatus, and especially, to a power supply apparatus for a high-pressure discharge lamp that is used as a light source of a projector apparatus, wherein the amount of mercury enclosed in the discharge lamp is 0.15 mg/mm3 or more.

DESCRIPTION OF THE RELATED ART

FIG. 4 shows a power supply apparatus for a high-pressure discharge lamp.

The power supply apparatus comprises a chopper circuit 1 having a switching element Qx, a smoothing circuit 2 having a coil Lx and a capacitor Cx, and a starter circuit 3 for initiating lighting, and a control circuit 4 which drives the switching element Qx.

The control circuit 4 detects operating voltage and operating current of the discharge lamp 10 by using resistors R1, R2, and R3, and converts them into lamp power which is compared with a standard electric power value, so that feedback control of the switching element Qx is carried out. Current controlled in the chopper circuit 1 is served as a direct current output in the smoothing circuit 2, and is supplied to the discharge lamp 10.

First, when a high voltage pulse is generated by the starter circuit 3 in a lighting operation, dielectric breakdown occurs between electrodes of the discharge lamp 10, thereby producing a glow discharge. The glow discharge turns into arc discharge soon, so that the discharge lamp is stabilized. The operating voltage of the discharge lamp in an arc discharge state is lower than the operating voltage of the discharge lamp in a glow discharge state.

A period during which the glow discharge state remain, changes depending on lighting conditions etc., and that state may continue for a couple of microseconds to tens of milliseconds or more.

The capacitor Cx contained in the smoothing circuit 2 is a smoothing capacitor for reducing high frequency ripple after shifting to the arc discharge, and has a comparatively large capacity.

Moreover, technology in that a capacitor having a small capacity is connected in parallel to the capacitor Cx in order to make the discharge state promptly shift from the glow discharge to the arc discharge is disclosed in, for example, Japanese Patent No. 3188873.

On the other hand, the amount of mercury enclosed in the discharge lamp used for a light source of a projector apparatus is very large. For this reason, the mercury in a liquid state (granular) adheres to electrodes more often when the discharge lamp is turned off. The electrodes made of metal are portions which are the easiest to get cold, and therefore, the mercury tends to be condensed on the electrodes by turning off the discharge lamp. When lighting of the discharge lamp is initiated from this state, arc discharge easily occurs from the mercury adhering to the electrodes, as a starting point. This arc discharge is different from the normal arc discharge described above, and may be called temporary special arc discharge. The arc discharge is unstable because the special arc discharge disappears when the mercury which has adhered to the electrodes evaporates so as to be depleted.

That is, although in case of a usual discharge lamp, the state of the discharge shifts from the glow discharge to the arc discharge after lighting (dielectric breakdown), in case that a large amount of mercury is enclosed in such a discharge lamp, the special arc discharge temporarily occurs in the glow discharge state.

Thus, if such special arc occurs, the discharge lamp cannot be stably turned on so that the light will be put out in early stages of lighting (going out).

BRIEF SUMMARY OF THE INVENTION

It is an object of the present invention to provide a high pressure discharge lamp lighting apparatus in which mercury of 0.15 mg/mm3 or more is enclosed. It is another object of the present invention to provide a high pressure discharge lamp lighting apparatus having a structure in which even if special arc occurs at the time of initial lighting, lighting of a discharge lamp is stably maintained without turning off.

In view of the above problems, a power supply apparatus for a high pressure discharge lamp according to the present invention, comprises a chopper circuit including a first switching element, a smoothing circuit including at least one smoothing capacitor which is connected to a first output of the chopper circuit, and a feedback system control circuit which drives the first switching element of the chopper circuit, wherein a parallel circuit comprising a resistor and a second switching circuit is in series connected to a second output terminal of the smoothing circuit, and wherein in the control circuit, at least at time of initial lighting, the second switching element is turned off, and the second switching element is turned on after the discharge lamp is stabilized.

A power supply apparatus for a high pressure discharge lamp, comprises a chopper circuit including a first switching element, a smoothing circuit including at least one smoothing capacitor which is connected to a first output terminal of the chopper circuit, a feedback system control circuit which drives the first switching element of the chopper circuit; a full bridge circuit, connected to a second output terminal of the smoothing circuit which generates alternating current, and an in-series circuit comprising a resistor and a second switching circuit which is in parallel connected to at least one of third switching elements which form the full bridge circuit, wherein the control circuit, at least at initial lightings, the second switching circuit is turned on, and the second switching element is turned of after the discharge lamp is stabilized.

According to the structure described above, even if the special arc which originates from the adhered mercury at the time when lighting of the discharge lamp is started occurs, the state of the discharge can shift from the glow discharge to the arc discharge well without going out.

Thus, the present invention possesses a number of advantages or purposes, and there is no requirement that every claim directed to that invention be limited to encompass all of them.

In addition, the foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 6 shows a result of experiment according to the present invention; and

DETAILED DESCRIPTION OF THE INVENTION

Description of the present invention be given, referring to Embodiments. While the present invention is not necessarily limited to such embodiments, an appreciation of various aspects of the invention is best gained through a discussion of various examples in such an application.

Figure 1:
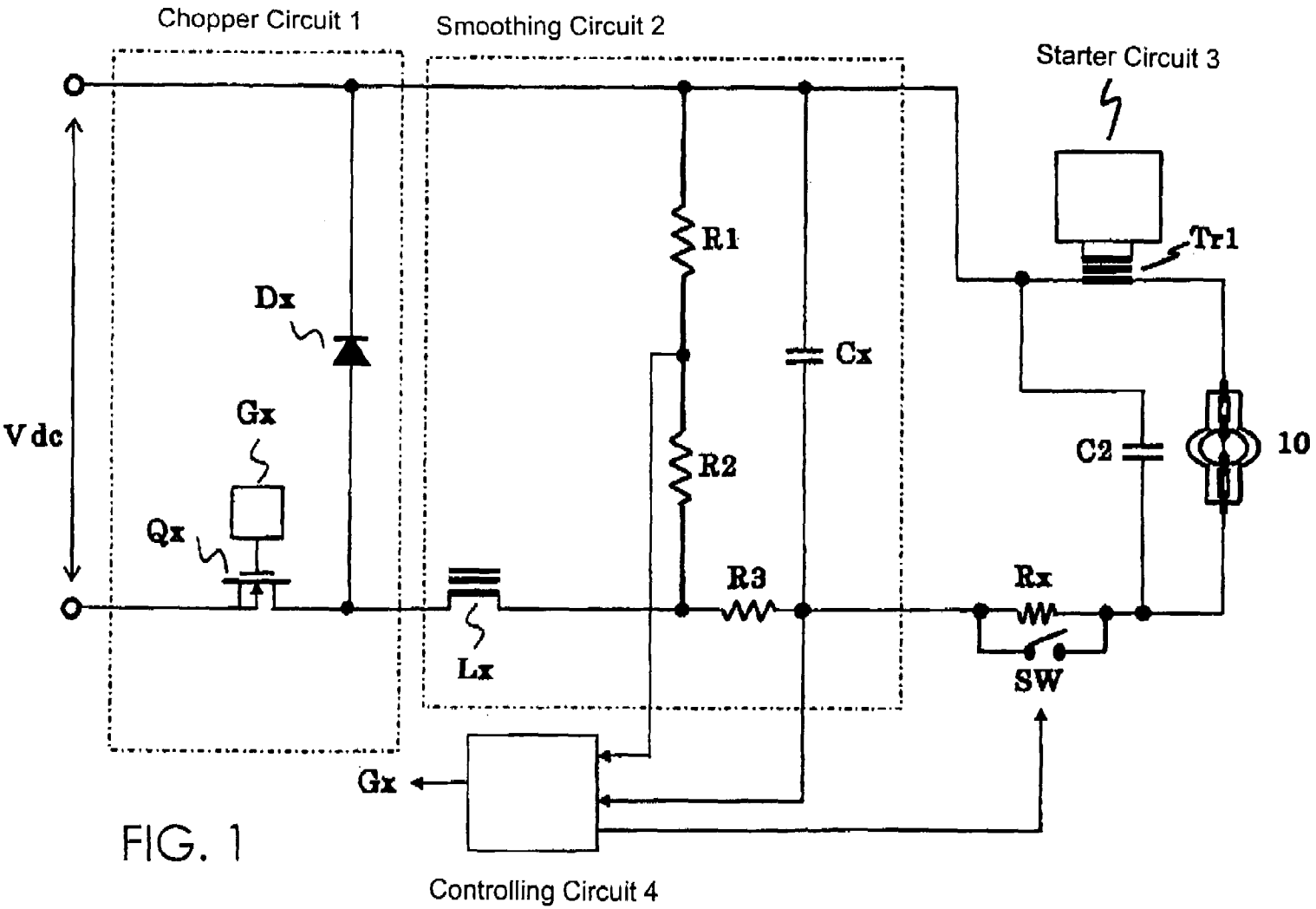
FIG. 1 shows a lamp lighting apparatus for high pressure discharge lamp according to the present invention.

FIG. 1 shows a power supply apparatus for a high-pressure discharge lamp according to the present invention.

The power supply apparatus comprises a chopper circuit 1, a smoothing circuit 2, a starter circuit 3 that is a starting device, and a control circuit 4. A lighting apparatus comprises the power supply apparatus and a discharge lamp 10. The chopper circuit 1 has a switching element Qx, a drive circuit Gx which controls the switching element Qx, and a diode Dx, and convents direct current from a direct-current power source Vdc into a current value corresponding to a predetermined switching cycle. A parallel circuit comprising a resistor Rx and a second switching element SW (hereinafter merely referred to as a "switching element") is in series connected to an output terminal of the smoothing circuit 2. The smoothing circuit 2 has a coil Lx and a capacitor Cx in order to smooth an output of the chopper circuit 1. The starter circuit 3 has an igniter transformer Tr1, and generates a high-voltage pulse at the time of initial lighting of the discharge lamp 10.

In response to a voltage signal and a current signal from resistors R1, R2, and R3, the control circuit 4 compares lighting power for the discharge lamp with a reference value, and transmits it to the drive circuit Gx. Thereby, feedback control of the discharge lamp 10 is carried out. Operating voltage and operating current of the discharge lamp 10 is detected by using resistors R1, R2, and R3, wherein the operating voltage is detected by using the resistors R1 and R2, and the operating current is detected by using the resistor R3. Although described later, the amount of mercury enclosed in the discharge lamp 10 is 0.15 mg/mm$^3$ or more.

Figure 4:
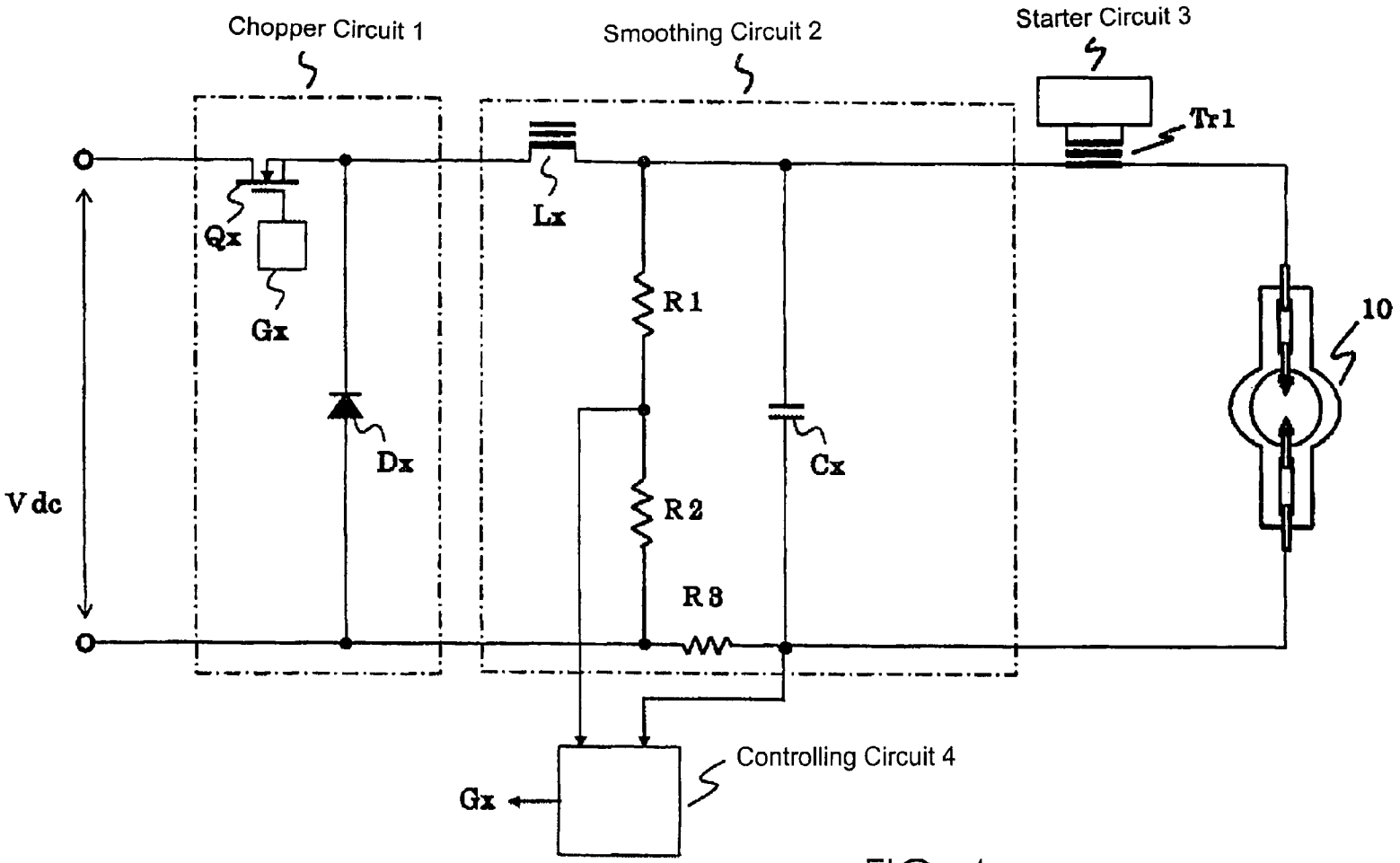
FIG. 4 PRIOR ART
FIG. 4 shows a high pressure discharge lamp lighting apparatus.

Moreover, although the switching element Qx is connected to the negative line as compared with FIG. 4, circuit functions thereof are not different from each other.

Next, an operation at the time of the initial lighting of the discharge lamp 10 will be described.

First, when a transformer Tr11 generates a high-voltage pulse by the starter circuit 3, breakdown is carried out between the electrodes of the discharge lamp 10, so as to initiate a discharge. As a numerical example, the high voltage pulse is several kV to tens of kV.

If dielectric breakdown arises in the discharge lamp, current is supplied from the chopper circuit 1. At this time, the switching element SW which is in series connected to the output terminal of the smoothing circuit 2 becomes an OFF state. Although the discharge lamp is in a glow discharge state after the dielectric breakdown, special arc discharge occurs temporarily. Here, the lamp voltage is high at the time of the glow discharge, and the lamp voltage becomes low at time of the arc discharge. That is, if special arc discharge occurs temporarily and then it returns to a glow discharge state, the lamp voltage changes from a low state to a high state. Since the change takes place for a very short time, it is not possible to carry out a feedback system control through the control circuit 4, so that the discharge lamp is turned off.

As a numerical example, time during which the feedback system control can be reacted is about 200 microseconds, and on the other hand, in order to prevent going out of a discharge lamp, a reaction needs to take place, at least within 100 microseconds.

In the present invention, at initial lighting of the discharge lamp, by turning off the switching element SW which is in series connected to the output terminal of the smoothing circuit 2, it is possible to supply current more quickly than that of the feedback system control. That is, current is mainly supplied through the switching element Qx, when voltage does not change rapidly without special arc discharge, while electric charges of the smoothing capacitor Cx, which are charged to the high voltage, are supplied to a lamp through Resistance Rx when the voltage change rapidly, so as to supply current.

The switching element SW may be turned off immediately after the starter circuit 3 is initiated or before the starter circuit 3 is initiated. What is necessary is to turn it off at time when a special arc occurs. The switching element SW is not limited to that described in the embodiment, and any element can be adopted if the element has switch-functions, such as MOSFET, a bipolar transistor, and a relay.

Again, a resistor Rx is connected thereto in order to improve the ability of initial lighting, wherein, for example, the resistance is, for example, about 90 Ω.

Although opening-and-closing control (on-off control) of the switching element SW is not illustrated, but for example, the switching element SW is operated, by working with a timer circuit disposed in the control circuit 4 or the starter circuit.

After the discharge lamp 10 is stabilized, unnecessary generation of heat can be eliminated by turning on the switching element SW.

The ON-timing is determined by a method of measuring a stable voltage value in a state of arc discharge by detecting the lamp voltage based on the resistors R1 and R2, or by time beforehand measured from the initiation of the starter circuit by a timer circuit.

These operations are performed by the control circuit 4 and opening-and-closing control is carried out by driving the switching element SW. Depending on the kind of the lamp, the discharge lamp is stabilized, after the discharge state changes to the arc discharge (not special arc discharge) and two (2) or more seconds after the initial lighting, usually 4 to 5 seconds thereafter.

Description of the special arc discharge will be given below.

As described above, in the discharge lamp whose amount of enclosed mercury is 0.15 mg/mm$^3$ or more, the mercury often adheres to the electrodes when lighting of the discharge lamp is initiated.

And if discharge occurs from the mercury as a starting point, at that moment, the state is close to arc discharge rather than glow discharge. (As a matter of convenience, this discharge is called "special arc discharge"). And when the mercury adhering to the electrodes becomes the starting point of a special arc, the mercury evaporates comparatively for a short time. Under these circumstances, if another discharge arc occurs from another mercury (mercury adhering to a different portion of the electrode) or if the discharge shifts well to discharge originated from the cathode, it becomes possible to maintain the discharge, but when either cannot be maintained well, the discharge lamp goes out.

Moreover, depending on the kind of discharge lamp, the voltage between the electrodes is in general at a level of 10V in an early stage of initial lighting of the arc discharge, while the voltage between the electrodes in the glow discharge is 100–200V. Therefore, when the state of the discharge changes from the glow discharge to the special arc or the special arc to the glow discharge, the voltage between the electrodes changes extraordinarily.

Figure 2:
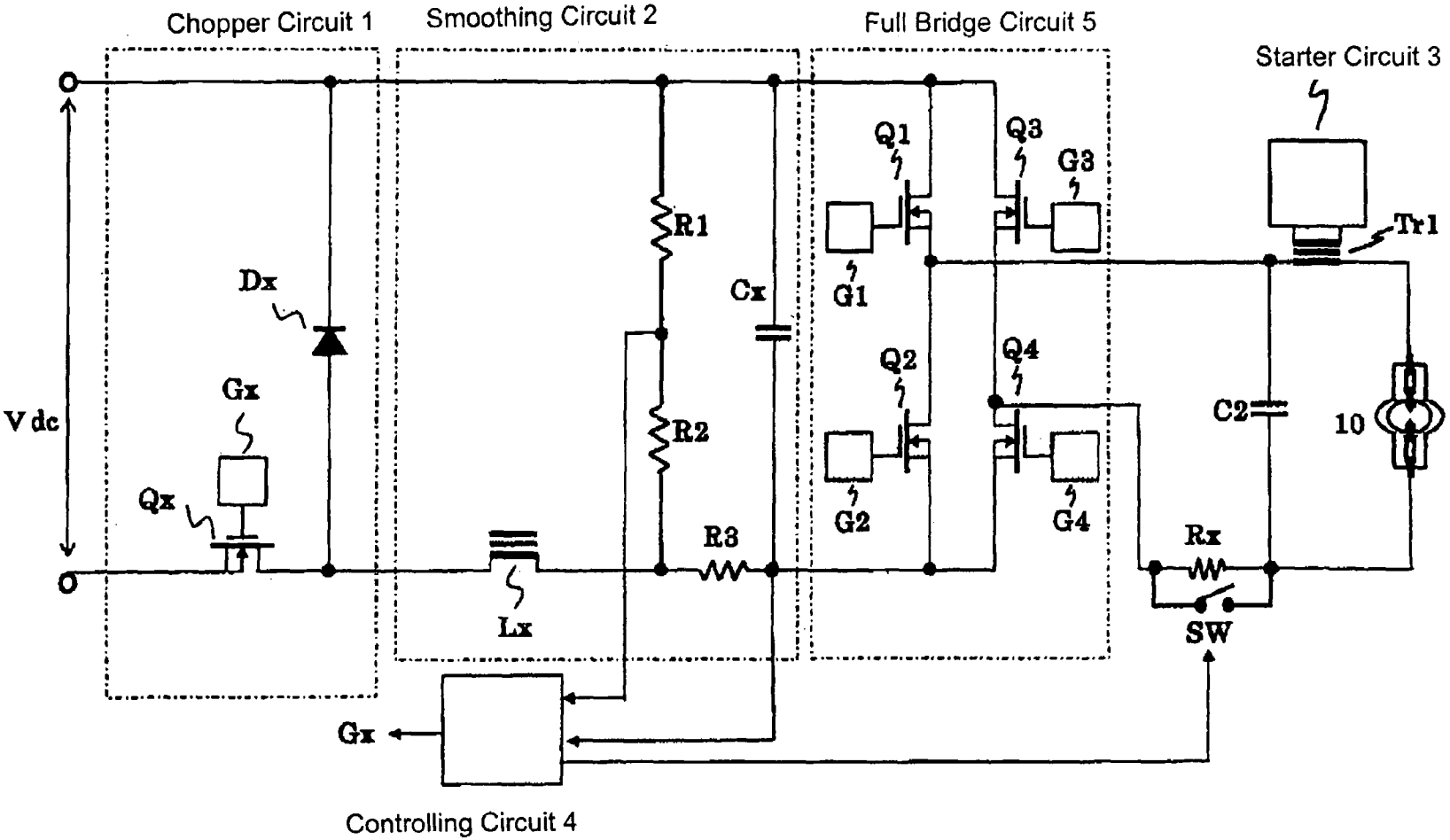
FIG. 2 shows a lamp lighting apparatus for high pressure discharge lamp according to the present invention.

FIG. 2 shows a lighting apparatus of an alternating current type discharge lamp, which is a modified example of that shown in FIG. 1.

The structure of the circuit, shown in FIG. 2 is basically the same as that shown in FIG. 1, except that a full bridge circuit 5 is disposed between the smoothing circuit 2 and the discharge lamp 10. The full bridge circuit 5 has switching elements Q1–Q4 which comprise transistors or FETs connected in form of a bridge, and drive circuits G1–G4 for the switching elements Q1–Q4. Alternating rectangular waveform current is applied to the discharge lamp 10 by switching the switching elements Q1–Q4.

An example in which direct current flows therethrough at initial lighting, and then lighting is carried out by alternating current will be explained below.

The full bridge circuit 5 has switching elements Q1–Q4 which comprise transistors or FETs connected in form of a bridge, and drive circuits G1–G4 for the switching elements Q1–Q4. Alternating rectangular waveform current is applied to the discharge lamp 10 by switching the switching elements Q1–Q4. Specifically, at the time of initial lighting, a pair of the switching elements Q1 and Q4 is turned on, a pair of Q2 and Q3 is turned off, and current flows in the course of the switching element Q1→the transformer Tr11→the discharge lamp 10→the resistor Rx→the switching element Q4.

When the discharge lamp is stabilized, the pair of the switching element Q1 and Q4, and the pair of Q2 and Q3 are alternatively turned on and off, and the current which flows in the course of the switching element Q1→the transformer Tr11→the discharge lamp 10→the switch element SW→the switching empty hand Q4, and the current which flows in the course of the switching element Q3→the switch element SW→the discharge lamp 10→the transformer Tr11→the switching element Q2 is alternatively generated.

The function of the resistor Rx and the switching element SW is the same as that described above.

Figure 3:
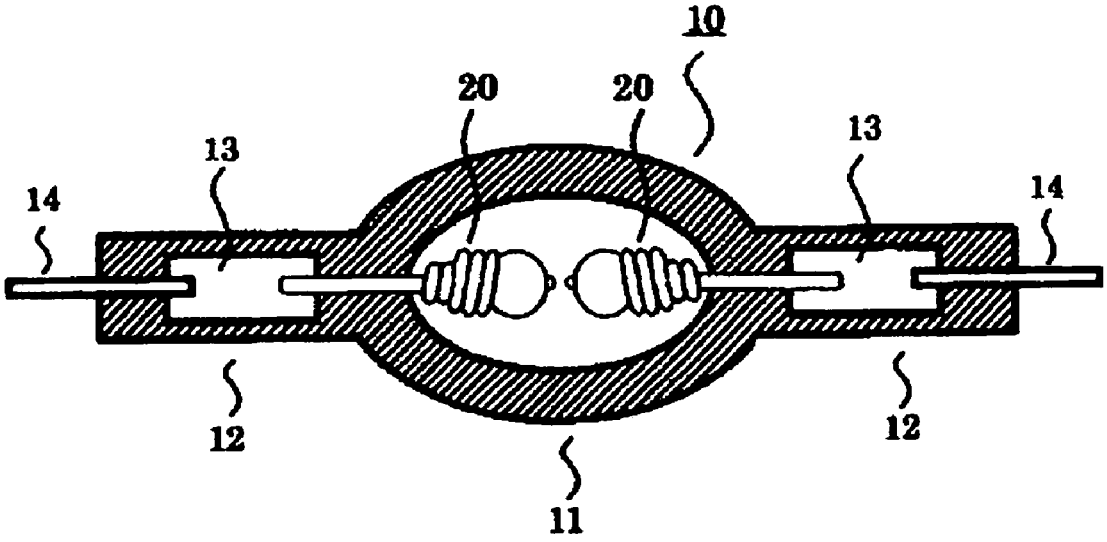
FIG. 3 shows a discharge lamp which is used for a high pressure discharge lamp lighting apparatus according to the present invention.

FIG. 3 shows the entire structure of the discharge lamp 10.

The discharge lamp 10 has an approximately spherical light emitting portion 11 formed as part of a discharge container made of quartz glass, wherein in the light emitting portion 11, a pair of electrodes 20 is disposed facing each other. A sealing portions 12 is formed so as to extend from each end portion of the light emitting portion 11, and in each sealing portion 12, a metallic foil for conduction 13 usually made of molybdenum is air-tightly buried by, for example, shrink sealing. Axis portion of the pair of electrodes 20 is electrically connected to the metallic foil 13 by welding. One end of each metallic foil 13 is connected to an external lead 14 which extends toward the outside.

In the light emitting portion 11, mercury, rare gas, and halogen gas is enclosed.

The mercury is used in order to obtain radiation of necessary visible light wavelength, for example, 400–700 nm wavelengths, wherein mercury of 0.15 mg/mm$^3$ or more is filled therein. The amount of the filling achieves extremely high vapor pressure that is 150 or more atmospheric pressure at time of lighting, depending on the temperature condition.

Moreover, it is possible to make a high mercury vapor pressure discharge lamp whose mercury vapor pressure is 200 or more atmospheric pressure, or 300 or more atmospheric pressure at time of lighting by enclosing much more mercury, so that it is possible to realize a light source suitable for a projector apparatus, as the mercury vapor pressure becomes higher.

For rare gas, for example, argon gas of 13 kPa is filled therein so that the lighting initiation property is improved. The halogen is enclosed in form of compound of iodine, bromine, chlorine etc. and metals such as mercury. The filled amount of halogen is selected from the range of, for example, 10–6 to 10–2 Pmol/mm$^3$. Although the function of the halogen is to extend the life time of the discharge lamp by using the halogen cycle, in case of an extremely small discharge lamp with high inner pressure, as described above, there is an advantage that devitrification or destruction of the discharge vessel is prevented by enclosing halogen.

In addition, in case of a discharge lamp for direct current lighting, the electrodes 20, that is, the cathode and anode are different from each other in shape, and in volume.

As a numerical example of such a discharge lamp, for example, the maximum outer diameter of the light emitting portion is such as 9.4 mm, the distance between the electrodes is, for example, 1.0 mm, the arc tube internal volume is, for example, 85 mm$^3$, the applied voltage is, for example, 75 V, and the applied power is, for example, 120 W, wherein the lamp is turned on by alternating current.

Moreover, such a discharge lamp is built in a projector apparatus etc. to be miniaturized, and while the entire structure is miniaturized extremely, the high intensity light is required. Therefore, heat effects in the arc tube are extremely severe and, for example, the tube wall load is selected from a range of 0.8–2.0 W/mm$^2$, such as 1.3 W/mm$^2$.

And when the discharge lamp is disposed in an apparatus for presentations like a projector apparatus or an overhead projector, which has high mercury evaporation pressure or high tube wall load, radiation light with good color rendering nature can be provided.

Figure 5:
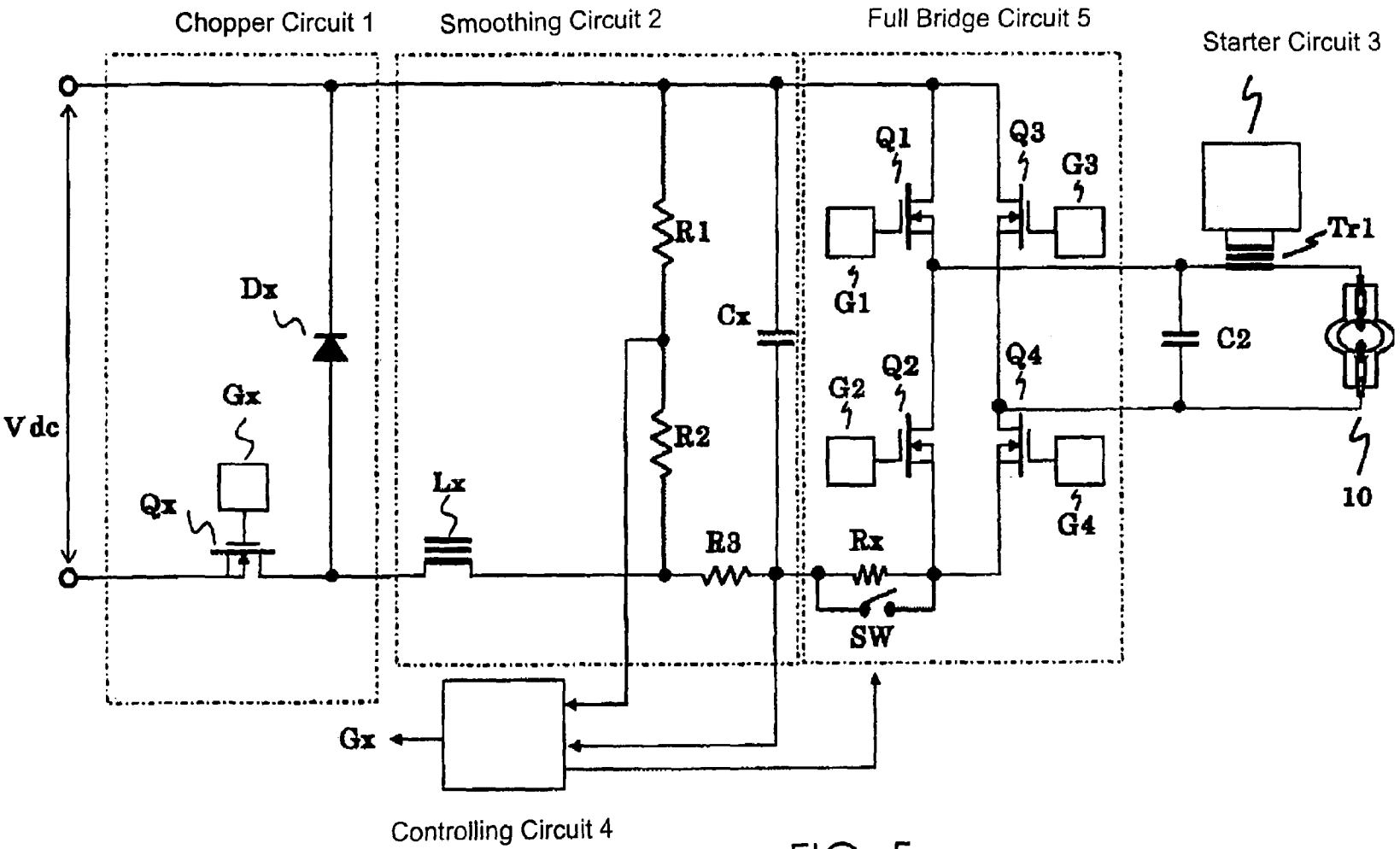
FIG. 5 shows a high pressure discharge lamp lighting apparatus according to the present invention.

FIG. 5 shows a modified example of the power supply apparatus shown in FIG. 2.

A circuit shown in FIG. 5 is different from that shown in FIG. 2, in that while in the circuit shown in FIG. 2, the parallel circuit comprising the resistor Rx and the switching element SW is in series connected to the output terminal of the full bridge circuit 5, the parallel circuit comprising the resistor Rx and the switching element SW is in series connected between a smoothing circuit and a full bridge circuit. In either case, the parallel circuit comprising the resistor Rx and the switching element SW is in series connected to the lamp 10, and the function of the resistor Rx and the switching element SW is same as that shown in FIG. 2.

A negative characteristic thermistor may be used for the parallel circuit comprising the resistor Rx and the switching element SW. In this case, the driving circuit for turning on/off the switch is not necessary, thereby functioning by a self-operation of the negative characteristic thermistor.

In case that a coil is in series connected to the discharge lamp, light fluctuation can be reduced by reducing inductance of the coil, so that it is advantageous for a projector apparatus. In case that a single plate DMD and a color filter are used as a light modulation device, light attenuation can be reduced. It is advantageous that there is no need to synchronize the switching of polarity of the discharge lamp with the light modulation device.

However, energy accumulated in the inductance becomes small by reducing the inductance of the coil. As a result, the released energy from the coil becomes small so that the ability to start lighting of the discharge lamp may be deteriorated, even if the capacitance of the capacitor Cx is small. The load of the capacitor cannot follow rapid voltage charge of the load, and although the inductance can follow rapid charge, the function is deteriorated largely by making the inductance small. In such case, it is advantageous that ability of initial lighting is secured without respect to a value of the capacitor Cx if the resister Rx is in series connected to an output of chopper, that is, it is in series connected to the lamp 10.

In FIG. 2, a means for generating alternating current is not limited to the full bridge circuit, and may be other circuit. Specifically, the number of the switching elements is not limited to four as long as a turning on/off operation can be carried out alternatively by interposing dead time with at least two switching elements.

Further, the starter circuit 3 is not limited to a system in which a high voltage transformer is connected to a current path of the discharge lamp, and may be a system in which a trigger wire is disposed on an outer surface of discharge lamp 10, and high voltage for initiation is applied from the high voltage transformer in which discharge lamp current does not flow to the transformer (which is so called an outside trigger type).

Next, description of an experiment of a power supply apparatus for a high pressure discharge lamp will be given below.

By using a register Rx having resistance of 40 Ω, 50 Ω, 60 Ω, 70 Ω, 100 Ω, 200 Ω, 300 Ω, and shorted.(that is, the conventional circuit in which the resistor Rx is not connected thereto,) a state of lighting of the discharge lamp in each case is observed. In each case, the discharge lamp is turned off after the discharge lamp is stabilized, and then the discharge lamp is restarted in 1, 1.5, 2, and 5 minutes (initiation of the starter). It is observed whether or not the discharge lamp is restarted by the initiation of re-lighting. The alternating current lighting type discharge lamp shown in FIG. 3 and described above was used, wherein the rated power 120 W, rated voltage 75V, rated current 1.6 A, and the distance between the electrodes is 1.0 mm. The circuit shown in FIG. 2 was used, wherein current at time of initiation is 1 A (output current of the chopper circuit at least time during which the switch is turned off).

In FIG. 6, the results of the experiment are shown.

All the discharge lamps were turned on by re-initiation one minute and one and half minutes after the lamp was turned off. This is because the discharge lamp was in a state where it was ready to restart (an arc discharge state) since a lot of time has not passed after the lamp is turned off. In cases where the resistor Rx was shorted (which corresponds to the case where the resistor Rx was removed) and the resistance of the resistor Rx is 40 Ω and 50 Ω, the discharge lamp could not be turned on at two minutes after the lamp was turned off. However, in cases where the resistance of the resistor Rx is 60 Ω or larger, the discharge lamp could be turned on without respect to the resistance. It is proved that the discharge lamp can be turned on by connecting a resistor having a resistance of 60 Ω or larger, even though it is in a glow discharge state.

Moreover, in cases where the discharge lamp was restarted two and half minutes after the lamp was turned off, when the resistor Rx is shorted or the resistor Rx having a resistance 40 Ω is used, the discharge lamp could not be restarted. On the other hand, in case where the resistor Rx having a resistance 50 Ω or larger is used, the discharge lamp could be turned on. As a result, it is shown that the lamp can be turned on if the value of the current flowing through the resistor Rx is larger than a certain value.

In addition, the voltage in FIG. 6, means voltage of the resistor Rx with the current at the initiation.

Thus, the discharge lamp can be re-lighted well one to two minutes after it is turned off, that is, it is possible to maintain the lighting even though the discharge lamp changes to the glow discharge after the special arc discharge.

In addition, in the experiment, it is proved that the discharge is maintained at high possibility in case where the voltage applied to the resistor is 50 V or larger.

Figure 7:
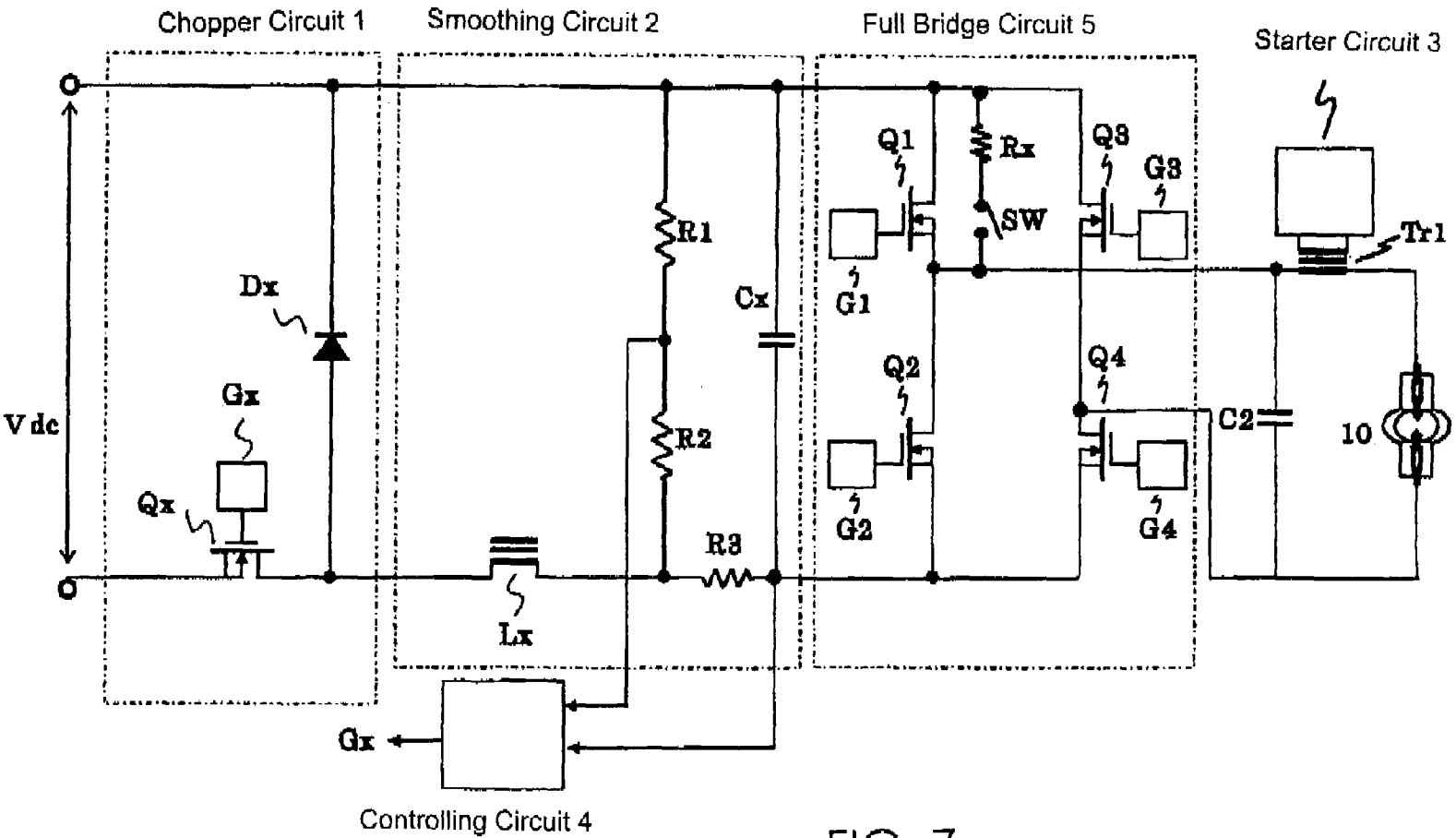
FIG. 7 shows a high pressure discharge lamp lighting apparatus according to the present invention.

FIG. 7 shows another embodiment of the power supply apparatus of the high pressure discharge lamp according to the present invention. The circuit shown in the figure is different from those shown in FIGS. 2 and 5, in that the resistor Rx and the second switching element SW are arranged in the full bridge 5, and the resistor Rx and the switching element is in series connected. Other structure is basically the same as those shown in FIGS. 2 and 5.

The in-series circuit comprising the resistor Rx and the switching element SW is in parallel connected to the switching element Q1 which forms the full bridge circuit 5.

Description of an operation of the circuit will be given. As described above, in a static state, alternating current flows through the discharge lamp by alternatively turning on and off the pair of the switching element Q1 and Q4 and the pair of the switching elements Q2 and Q3. At initial lighting, direct current is applied to the discharge lamp 10 and after the lighting of the discharge lamp is stabilized, that is, in case of the static state, the lighting is shifted to alternating lighting. In an operation of the circuit, while only the switching element Q4 among the four switching elements which form the full bridge circuit is turned on and other switching elements Q1, Q2, and Q3 are turned off, so that the second switching element SW, which is connected in parallel to the SW Q1 is turned on. When dielectric breakdown occurs in the discharge lamp 10, direct current flows in the order of the resister Rx→the second switching element SW→the transformer Tr11→the discharge lamp 10→the switching element Q4. In the embodiment, by applying current to the discharge lamp 10 through the resister Rx, which in series connected to the discharge lamp 10 it is possible to promptly supply current as compared with a feed back system.

The switching element Q4 and the second switching element SW may be turned on before the starter circuit 3 is initiated or right after the starter circuit 3 is initiated. What is necessary is that the operation is carried out at time the special arc discharge occurs.

After the discharge lamp 10 shifts to the arc discharge, while the second switching element SW is turned off, the switching element Q1 is turned on so that direct current can be supplied. Or while the second switching element SW is turned on, the switching element Q1 is turned on, and in a short time after that, the switching element SW may be turned off. In either case, it is possible to eliminate unnecessary generation of heating in the resistor Rx by reducing current flowing through the resistor Rx. In addition, the in-series circuit comprising the resistor Rx and the switching element SW may be in parallel connected to any of the switching elements which form the full bridge circuit 5, wherein the switching element to be turned on is determined based on the relationship to the switching element connected thereto.

As described above, in the power supply apparatus for high pressure discharge lamp according to the present invention, when the discharge lamp is turned on at time of initiation, even though mercury adheres to electrodes so that special arc discharge occurs, it is possible to shift well from the glow discharge to the arc discharge.

The disclosures of Japanese Patent Application Nos. 2004-227742 filed on Aug. 4, 2004 and 2004-353580 filed on Dec. 7, 2004 including specification, drawings and claims are incorporated herein by reference in its entirety.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A power supply apparatus for a high pressure discharge lamp, comprising:

a chopper circuit including a first switching element;

a smoothing circuit including at least one smoothing capacitor which is connected to a first output of the chopper circuit; and a feedback system control circuit which drives the first switching element of the chopper circuit, wherein a parallel circuit comprising a resistor and a second switching element and the high pressure discharge lamp are in series connected to a second output terminal of the smoothing circuit, and wherein in the control circuit, at least at time of initial lighting, the second switching element is turned off, and the second switching element is turned on after the discharge lamp is stabilized.

2. The power supply apparatus for a high pressure discharge lamp according to claim 1, wherein mercury of 0.15 mg/mm3 or more is enclosed in the high pressure discharge lamp.

3. A power supply apparatus for a high pressure discharge lamp, comprising:

a chopper circuit including a first switching element;

a smoothing circuit including at least one smoothing capacitor which is connected to a first output of the chopper circuit; and a feedback system control circuit which drives the first switching element of the chopper circuit; and a full bridge circuit connected to the smoothing circuit, which generates alternating current wherein a parallel circuit comprising a resistor and a second switching element, and the high pressure discharge lamp are in series connected to a second output terminal of the smoothing circuit, and wherein in the control circuit, at least at time of initial lighting, the second switching element is turned off, and the second switching element is turned on after the discharge lamp is stabilized.

4. A power supply apparatus for a high pressure discharge lamp, comprising:

a chopper circuit including a first switching element;

a smoothing circuit including at least one smoothing capacitor which is connected to a first output terminal of the chopper circuit;

a feedback system control circuit which drives the first switching element of the chopper circuit;

a full bridge circuit, connected to a second output terminal of the smoothing circuit which generates alternating current, and an in-series circuit comprising a resistor and a second switching element which is in parallel connected to at least one of third switching elements which form the full bridge circuit, wherein the control circuit, at least at initial lightings, the second switching element is turned on, and the second switching element is turned off after the discharge lamp is stabilized.

5. The power supply apparatus for a high pressure discharge lamp according to claim 4, wherein mercury of 0.15 mg/mm3 or more is enclosed in the high pressure discharge lamp.

* * * * *